US012116026B2

(12) United States Patent
Keener

(10) Patent No.: US 12,116,026 B2
(45) Date of Patent: Oct. 15, 2024

(54) CRASH ENERGY MANAGEMENT SYSTEMS FOR CAR COUPLING SYSTEMS OF RAIL CARS

(71) Applicant: Amsted Rail Company, Inc., Chicago, IL (US)

(72) Inventor: Scott A. Keener, Harrisburg, PA (US)

(73) Assignee: Amsted Rail Company, Inc., Chicago, IL (US)

( * ) Notice: Subject to any disclaimer, the term of this patent is extended or adjusted under 35 U.S.C. 154(b) by 718 days.

(21) Appl. No.: 17/399,137

(22) Filed: Aug. 11, 2021

(65) Prior Publication Data

US 2022/0242462 A1 Aug. 4, 2022

Related U.S. Application Data

(63) Continuation-in-part of application No. 17/183,404, filed on Feb. 24, 2021, which is a continuation-in-part of application No. 17/161,843, filed on Jan. 29, 2021.

(51) Int. Cl.
*B61G 11/12* (2006.01)

(52) U.S. Cl.
CPC ..... *B61G 11/12* (2013.01)

(58) Field of Classification Search
CPC ..... B61G 11/12; B61G 11/08; B61G 11/16; B61G 9/04
See application file for complete search history.

(56) References Cited

U.S. PATENT DOCUMENTS 2,277,881 A * 3/1942 Olander ..... B61G 9/10 213/26
2,457,979 A * 1/1949 Dath ..... B61G 9/10 267/209
4,111,406 A * 9/1978 Zanow ..... F16F 1/406 267/153

(Continued)

FOREIGN PATENT DOCUMENTS

DE 102016205981 10/2017
EP 1955918 8/2008

(Continued)

OTHER PUBLICATIONS

Notification of Transmittal of the International Search Report and the Written Opinion of the Internal Searching Authority, or the Declaration for PCT/US2022/037665, dated Nov. 21, 2022.

(Continued)

*Primary Examiner* — Scott A Browne
(74) *Attorney, Agent, or Firm* — Joseph M. Butscher; The small Patent Law Group, LLC

(57) ABSTRACT

A crash energy management system is configured to be disposed within a draft sill of a car coupling system for a rail vehicle. The crash energy management system includes a front sub-assembly including a front end plate, guide legs extending between the front end plate and a front central plate, a front central tube extending between the front end plate and the front central plate, and stop walls coupled to the guide legs. A rear sub-assembly is coupled to the front sub-assembly, and includes a rear end plate, a rear central plate, and a rear central tube extending between the rear end plate and the rear central plate.

24 Claims, 11 Drawing Sheets

(56) References Cited

U.S. PATENT DOCUMENTS

| | | | | |
|---|---|---|---|---|
| 7,735,427 | B2 * | 6/2010 | Gansweidt | B61G 7/10 105/396 |
| 9,290,189 | B2 * | 3/2016 | Kukulski | F16F 7/127 |
| 11,535,285 | B2 * | 12/2022 | Puszkarz | B61G 7/08 |

FOREIGN PATENT DOCUMENTS

| | | | |
|---|---|---|---|
| KR | 100658310 | B1 * | 12/2006 |
| WO | WO 2005/023618 | | 3/2005 |
| WO | WO 2012/067526 | | 5/2012 |
| WO | WO 2019/240660 | | 12/2019 |

OTHER PUBLICATIONS

International Preliminary Report on Patentability for PCT/US2021/059824, sent Aug. 10, 2023.

* cited by examiner

CRASH ENERGY MANAGEMENT SYSTEMS FOR CAR COUPLING SYSTEMS OF RAIL CARS

RELATED APPLICATIONS

This application is a continuation-in-part of U.S. patent application Ser. No. 17/183,404, filed Feb. 24, 2021, which is a continuation-in-part of U.S. patent application Ser. No. 17/161,843, filed Jan. 29, 2021, each of which is hereby incorporated by reference in its entirety.

FIELD OF THE DISCLOSURE

Embodiments of the present disclosure generally relate to coupling systems for rail vehicles, such as rail cars, and more particularly to car coupling systems having crash energy management systems.

BACKGROUND OF THE DISCLOSURE

Rail vehicles travel along railways, which have tracks that include rails. A rail vehicle includes one or more truck assemblies that support one or more car bodies.

When rail cars impact each other, longitudinal forces are exerted into car coupling systems thereof. If a maximum force limit is desired, energy attenuation devices can be used within the car coupling systems. A draft gear is such a device, but is usually limited with respect to forces that can be attenuated. However, when excessive forces are exerted into the car coupling system, there is a potential for damage to the car coupling systems.

SUMMARY OF THE DISCLOSURE

A need exists for a system and a method for attenuating energy exerted into a car coupling system. Further, a need exists for a system and a method that absorb energy that exceeds a predetermined force threshold. Moreover, a need exists for an efficient, effective, and low cost system for absorbing and attenuating such energy.

With those needs in mind, certain embodiments of the present disclosure provide a car coupling system for a rail vehicle. The car coupling system includes a draft sill, and a crash energy management system disposed within the draft sill. The crash energy management system includes a first end plate, a second end plate, and a central tube disposed between the first end plate and the second end plate. The central tube is configured to deform in response to a force exerted into the car coupling system that exceeds a predetermined force threshold. Deformation of the central tube attenuates at least a portion of the force.

In at least one embodiment, a coupler extends outwardly from a first end of the draft sill. Further, a first stop is within the draft sill. A draft gear having a yoke is also within the draft sill. The coupler connects to the draft gear. Additionally, a second stop is within the draft sill. In at least one embodiment, the crash energy management system is disposed between the draft gear and the second stop.

As an example, the crash energy management system is formed of steel.

In at least one embodiment, the central tube has a length, an outer diameter, and a wall thickness. A ratio of the length to the outer diameter is 2:1, and a ratio of the outer diameter to the wall thickness is 8:1.

In at least one embodiment, the crash energy management system further includes a supplemental tube within an internal chamber of the central tube. As an example, the supplemental tube has a length, an outer diameter, and a wall thickness. A ratio of the length to the outer diameter is 2:1, and a ratio of the outer diameter to the wall thickness is 8:1. In at least one embodiment, the supplemental tube is coaxial with the central tube.

In at least one embodiment, the crash energy management system further include one or more supplemental tubes outside of the central tube.

Certain embodiments of the present disclosure provide a method of forming a car coupling system for a rail vehicle. The method includes disposing a crash energy management system within a draft sill, as described herein.

Certain embodiments of the present disclosure provide a car coupling system for a rail vehicle. The car coupling system includes a draft sill. A first crash energy management system is disposed within the draft sill. The first crash energy management system includes a first end plate, a second end plate, and a first central tube disposed between the first end plate and the second end plate. The first central tube is configured to deform in response to a first force exerted into the car coupling system that exceeds a first predetermined force threshold. Deformation of the first central tube attenuates at least a portion of the first force. A second crash energy management system is also disposed within the draft sill. The second crash energy management system includes a third end plate, a fourth end plate, and a second central tube disposed between the third end plate and the fourth end plate. The second central tube is configured to deform in response to a second force exerted into the car coupling system that exceeds a second predetermined force threshold. Deformation of the second central tube attenuates at least a portion of the second force.

In at least one embodiment, the first force equals the second force, and the first predetermined force threshold equals the second predetermined force threshold. In at least one other embodiment, the first force differs from the second force, and the first predetermined forced threshold differs from the second predetermined force threshold.

In at least one embodiment, one or both of the first crash energy management system or the second crash energy management system is interchangeable with a third crash energy management system.

In at least one embodiment, the first crash energy management system is configured the same as the second crash energy management system. In at least one other embodiment, the first crash energy management system is configured differently than the second crash energy management system.

In at least one embodiment, the first central tube differs from the second central tube with respect to one or more of length, diameter, or wall thickness.

In at least one embodiment, one of the first crash energy management system or the second crash energy management system includes one or more supplemental tubes.

In at least one embodiment, the first crash energy management system includes one or more first supplemental tubes, and the second crash energy system includes one or more second supplemental tubes. As an example, the one or more first supplemental tubes differ from the one or more second supplemental tubes with respect to one or more of length, diameter, or wall thickness.

In at least one embodiment, the third end plate directly abuts the second end plate. In at least one embodiment, the second end plate and the third end plate are integrally formed together as a common intermediate plate.

In at least one embodiment, the car coupling system further includes a coupler extending outwardly from a first end of the draft sill, a first stop within the draft sill, a draft gear having a yoke within the draft sill, wherein the coupler connects to the draft gear, and a second stop within the draft sill. In at least one example, the first crash energy management system and the second crash energy management system are disposed between the draft gear and the second stop.

In at least one embodiment, each of the first central tube and the second central tube has a length, an outer diameter, and a wall thickness. A ratio of the length to the outer diameter is 2:1, and a ratio of the outer diameter to the wall thickness is 8:1.

Certain embodiments of the present disclosure provide a method of forming a car coupling system for a rail vehicle. The method includes disposing a first crash energy management system within a draft sill, and disposing a second crash energy management system within the draft sill.

Certain embodiments of the present disclosure provide a crash energy management system configured to be disposed within a draft sill of a car coupling system for a rail vehicle. The crash energy management system includes a front sub-assembly including a front end plate, guide legs extending between the front end plate and a front central plate, a front central tube extending between the front end plate and the front central plate, and stop walls coupled to the guide legs. A rear sub-assembly is coupled to the front sub-assembly. The rear sub-assembly includes a rear end plate, a rear central plate, and a rear central tube extending between the rear end plate and the rear central plate.

In at least one example, the guide legs extend from the front end plate at corners.

In at least one embodiment, each of the stop walls includes a forward end secured between interior edges surfaces of neighboring ones of the guide legs, and a rear end that extends toward the rear sub-assembly.

In at least one embodiment, one or more of the stop walls includes a recess pocket that exposes one or more weld lines of the front central plate and the rear central plate. In at least one embodiment, the stop walls are welded to the front central plate and the rear central plate.

One or more of the guide legs can include a first beam connected to a second beam, which is orthogonal to the first beam.

In at least one embodiment, the guide legs are configured to move over portions of the front central plate and the rear central plate as the front central tube deforms.

In at least one embodiment, each of the front central plate and the rear central plate is half the thickness of each of the front end plate and the rear end plate. The front central plate can be welded to the rear central plate.

One or both of the front end plate or the front central plate can include a front central bore that allows for welding to an inner diameter of the front central tube, and one or both of the rear end plate or the rear central plate can include a rear central bore that allows for welding to an inner diameter of the rear central tube.

In at least one example, each of the front central tube and the rear central tube has a length, an outer diameter, and a wall thickness, wherein a ratio of the length to the outer diameter is 2:1, and a ratio of the outer diameter to the wall thickness is 8:1.

Certain embodiments of the present disclosure provide a method of forming a car coupling system for a rail vehicle including disposing a crash energy management system (such as any described herein) within a draft sill.

Certain embodiments of the present disclosure provide a car coupling system for a rail vehicle. The car coupling system includes a draft sill, a coupler extending outwardly from a first end of the draft sill, a first stop within the draft sill, a draft gear having a yoke within the draft sill, wherein the coupler connects to the draft gear, a second stop within the draft sill, and a crash energy management system (such as any described herein) disposed between the draft gear and the second stop within the draft sill.

DETAILED DESCRIPTION OF THE DISCLOSURE

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Embodiments of the present disclosure provide a crash energy management system for a coupling system of a rail vehicle. The crash energy management system can be used in series with a draft gear to attenuate energy above and beyond that which a typical draft gear is configured to handle, thereby keeping a peak force below a desired limit. In at least one embodiment, the crash energy management system includes a canister with flanges at each end. When force that exceeds a predetermined force threshold is exerted into the coupling system, the crash energy management system plastically deforms (such as via concertina buckling), and strokes a prescribed distance while managing the energy and force during the impact. In at least one embodiment, the crash energy management system is akin to a mechanical fuse. Once deformed, the crash energy management system may be unable to return to a non-deformed state. As such, the crash energy management system may not be reused after deformation.

Figure 1:
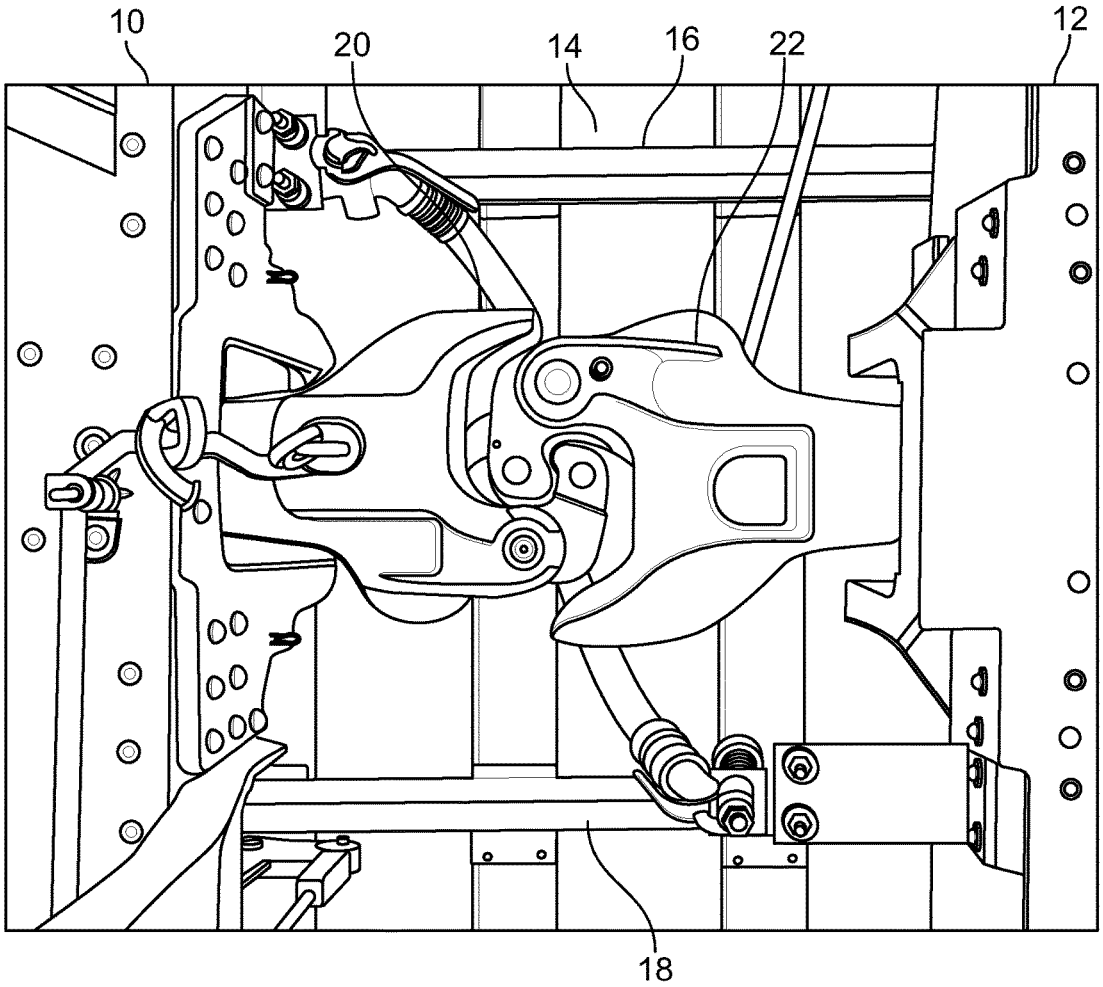
FIG. 1 illustrates a top view of a first rail car coupled to a second rail car.

FIG. 1 illustrates a top view of a first rail car 10 coupled to a second rail car 12. The first rail car 10 and the second rail car 12 are configured to travel along a track 14 having rails 16 and 18. A coupler 20 of the first rail car 10 connects to a coupler 22 of the second rail car 12.

Figure 2:
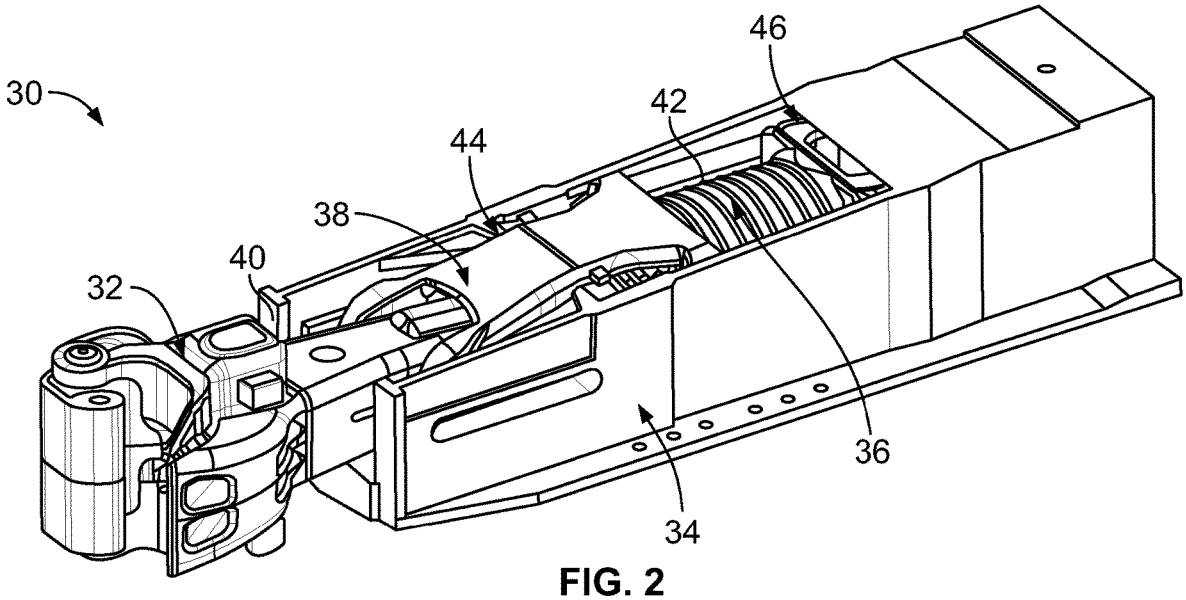
FIG. 2 illustrates a perspective top view of a car coupling system.

FIG. 2 illustrates a perspective top view of a car coupling system 30. The first rail car 10 and the second rail car 12 include a car coupling system 30. The car coupling system 30 includes a coupler 32 (such as the coupler 20 or the coupler 22 shown in FIG. 1), a draft sill 34, and a draft gear 36 with yoke 38. The coupler 32 is supported at a first end 40 by the draft sill 34 and at an opposite second end 42 by the draft gear 36 or cushion unit with the yoke 38. The draft gear 36 or cushion unit is constrained within the draft sill 34 by a pair of front stops 44 and a pair of rear stops 46.

Figure 3:
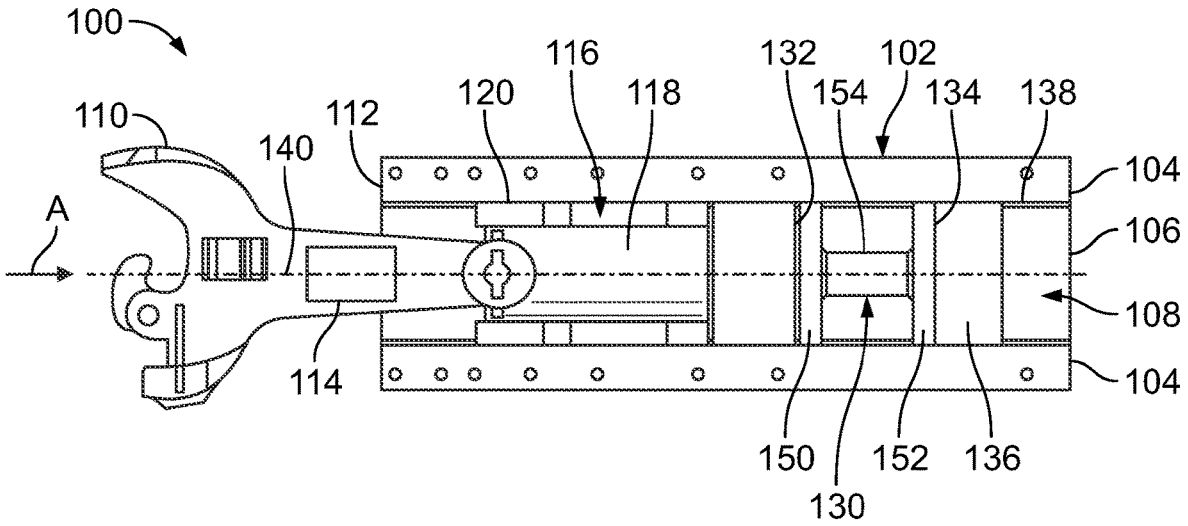
FIG. 3 illustrates a bottom view of a car coupling system, according to an embodiment of the present disclosure.
Figure 4:
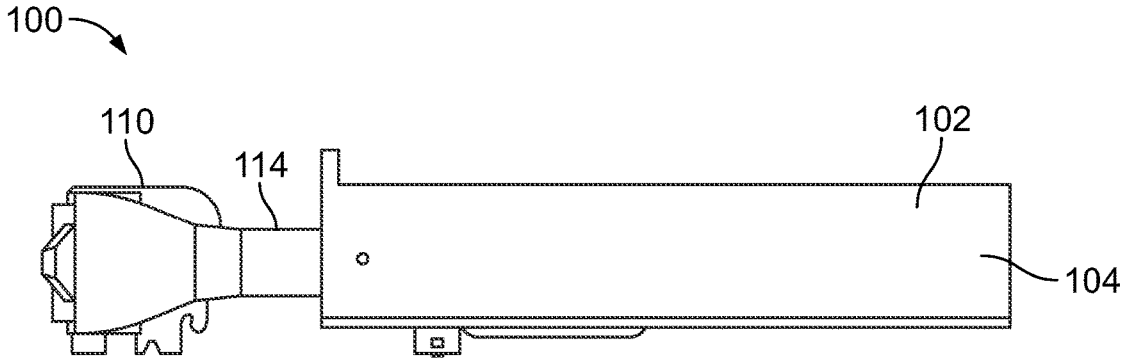
FIG. 4 illustrates a lateral view of the car coupling system of FIG. 3.

FIG. 3 illustrates a bottom view of a car coupling system 100, according to an embodiment of the present disclosure. FIG. 4 illustrates a lateral view of the car coupling system 100 of FIG. 3. Referring to FIGS. 3 and 4, the car coupling system 100 includes a draft sill 102 including lateral walls 104 connected to a top wall 106. A chamber 108 is defined between the lateral walls 104 and the top wall 106. A carrier plate secures to the lateral walls 104 opposite from the top wall 106. For the sake of clarity, the carrier plate is not shown.

A coupler 110 extends outwardly from a first end 112 (for example, a fore end) of the draft sill 102. A shank 114 of the coupler 110 extends into the chamber 108 and connects to a draft gear 116. The draft gear 116 includes a yoke 118. A first stop 120 is secured to internal portions of the draft sill 102. At least a portion of the draft gear 116 is disposed behind (that is, further from the first end 112) the first stop 120.

A crash energy management system 130 is disposed within the draft sill 102 between an aft end 132 of the draft gear 116 and a fore end 134 of a second stop 136, which is proximate to a second end 138 (for example, an aft end) of the draft sill 102. The crash energy management system 130 is longitudinally aligned with the draft gear 116. For example, the crash energy management system 130 and the draft gear 116 are longitudinally aligned along a central longitudinal axis 140 of the car coupling system 100.

In at least one embodiment, the crash energy management system 130 is aligned in series between the draft gear 116 and the second stop 136. As shown, the crash energy management system 130 is disposed behind the draft gear 116 and in front of the second stop 136.

As described herein, the crash energy management system 130 provides a mechanical fuse that is configured to deform when a force exceeding a predetermined force threshold is exerted into the car coupling system 100 in the direction of arrow A, for example. By deforming in response to the force in the direction of arrow A that exceeds a predetermined force threshold, the crash energy management system 130 attenuates and absorbs at least a portion of the force, thereby ensuring that other components of the car coupling system 100 and associated rail car are not subjected to the peak force. In this manner, the crash energy management system 130 prevents or otherwise reduces potential damage to the car coupling system 100 and the rail car.

Figure 5:
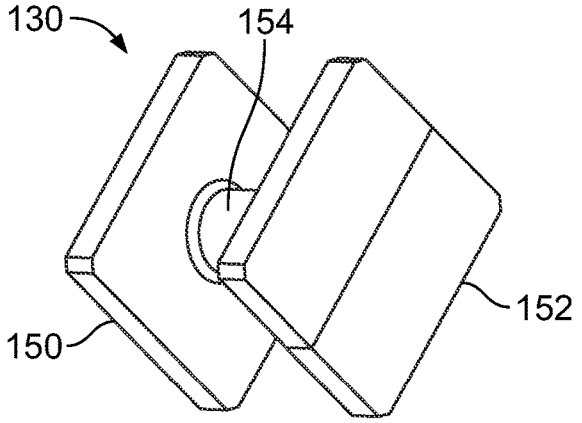
FIG. 5 illustrates a perspective view of a crash energy management system, according to an embodiment of the present disclosure.

FIG. 5 illustrates a perspective view of the crash energy management system 130, according to an embodiment of the present disclosure. In at least one embodiment, the crash energy management system 130 is formed of a metal, such as steel aluminum, or the like. As another example, the crash energy management system 130 can be formed of a plastic, such as resin. As another example, the crash energy management system 130 can be formed of metal and plastic.

The crash energy management system 130 includes a first end plate 150 connected to a second end plate 152 by a central tube 154 (for example, a canister). Referring to FIGS. 3 and 5, the first end plate 150 abuts against the aft end 132 of the draft gear 116, and the second end plate 152 abuts against the fore end 134 of the second stop 136. The first end plate 150 may be secured to the aft end 132 through one or more fasteners, adhesives, and/or the like. Similarly, the second end plate 152 may be secured to the fore end 134 through one or more fasteners, adhesives, and/or the like. In at least one other embodiment, the first end plate 150 and the second end plate 152 are not fastened or otherwise fixed to the aft end 132 and the fore end 134, respectively, with fasteners and/or adhesives.

Figure 6:
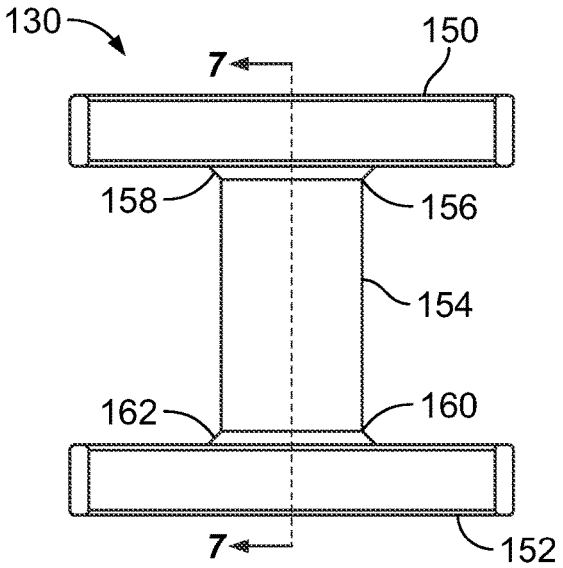
FIG. 6 illustrates a lateral view of the crash energy management system of FIG. 5.

FIG. 6 illustrates a lateral view of the crash energy management system 100 of FIG. 5. In at least one embodiment, the central tube 154 has a circular axial cross-section. A first end 156 of the central tube 154 can be secured to the first end plate 150 at a weld line 158. Similarly, a second end 160 of the central tube 154 can be secured to the second end plate 152 at a weld line 162.

Figure 7:
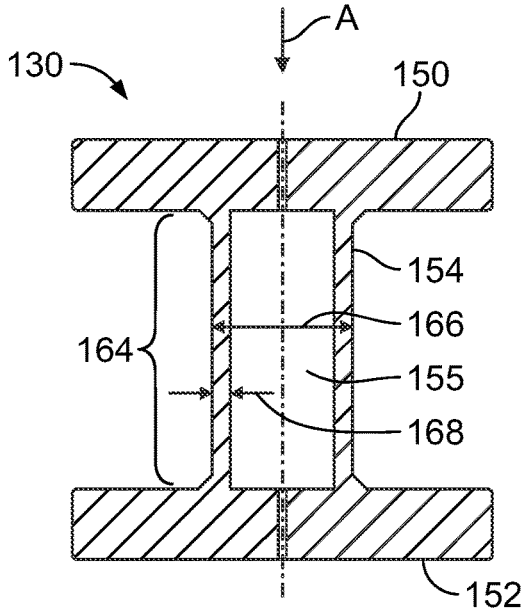
FIG. 7 illustrates a cross-sectional view of the crash energy management system through line 7-7 of FIG. 6.

FIG. 7 illustrates a cross-sectional view of the crash energy management system 130 through line 7-7 of FIG. 6. In at least one embodiment, the central tube 154 is hollow, having an internal chamber 155. The central tube 154 includes a length 164, an outer diameter 166, and a wall thickness 168. In order to achieve concertina buckling upon deformation (in response to experiencing force in the direction of arrow A), the ratio of the length 164 to outer diameter 166 is 2:1. For example, the length 164 can be 8 inches, and the outer diameter 166 is 4 inches. Optionally, the length 164 can be greater or less than 8 inches, and the outer diameter 166 can be greater or less than 4 inches. For example, the length 164 can be 4 inches, and the outer diameter 166 can be 2 inches.

Further, in order to achieve concertina buckling, the ratio of the outer diameter 166 to the wall thickness 168 is 8:1. For example, the outer diameter is 4 inches, and the wall thickness 168 is 0.5 inches. Optionally, the outer diameter 166 can be greater or less than 4 inches, and the wall thickness 168 can be greater or less than 0.5 inch. For example, the outer diameter 166 can be 8 inches, and the wall thickness 168 can be 1 inch.

Plastic deformation of the central tube 154 via concertina buckling is desirable as it exhibits an ideal force travel curve. As noted, in order to ensure concertina buckling, the ratio of the length 164 to the outer diameter 166 is 2:1, while the ratio of the outer diameter 166 to the wall thickness 168 is 8:1. Alternatively, the outer tube 154 can be sized and shaped differently so as not to provide concertina buckling.

Figure 8:
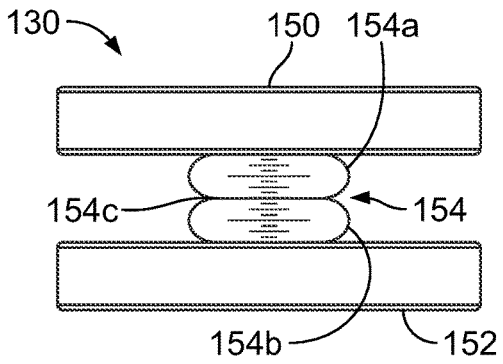
FIG. 8 illustrates a lateral view of the crash energy management system in a deformed state, according to an embodiment of the present disclosure.

FIG. 8 illustrates a lateral view of the crash energy management system 130 in a deformed state, according to an embodiment of the present disclosure. Referring to FIGS. 3-8, when a force that exceeds a predetermined force threshold is exerted into the car coupling system 100 in the direction of arrow A, the central tube 154 deforms, thereby absorbing and attenuating the energy of the force. As shown in FIG. 8, the deformation occurs as concertina buckling, in which the central tube 154 deforms into a first axially compressed and radially expanded bulge 154*a* separated from a second axially compressed and radially expanded bulge 154*b* by an intermediate seam 154*c*.

Referring to FIGS. 1-8, the car coupling system 100 for a rail vehicle includes the draft sill 102, and the crash energy management system 130 disposed within the draft sill 102. The crash energy management system 130 includes the first end plate 150, the second end plate 152, and the central tube 154 disposed between the first end plate 150 and the second end plate 152. The central tube 154 is configured to deform in response to a force exerted into the car coupling system 100 that exceeds a predetermined force threshold. Deformation of the central tube 154 attenuates at least a portion of the force.

Figure 9:
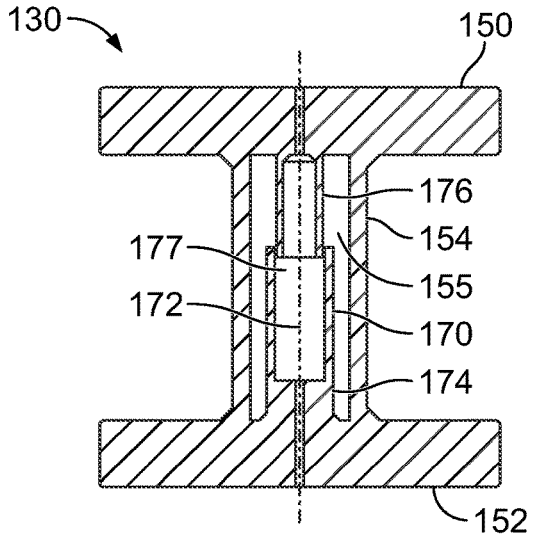
FIG. 9 illustrates a cross-sectional view of the crash energy management system through line 7-7 of FIG. 6, according to an embodiment of the present disclosure.

FIG. 9 illustrates a cross-sectional view of the crash energy management system 130 through line 7-7 of FIG. 6, according to an embodiment of the present disclosure. Depending on the amount of energy attenuation desired, a supplemental tube 170 can be disposed within the internal chamber 155 of the central tube 154. In at least one embodiment, the supplemental tube 170 is coaxial with the central tube 154. For example, the central tube 154 and the supplemental tube 170 are coaxial with a central longitudinal axis 172 of the crash energy management system 130.

In at least one embodiment, the supplemental tube 170 is a half scale of the central tube 154. In order to achieve concertina buckling upon deformation, the central tube 154 and the supplemental tube 170 are both sized and shaped to have a length to outer diameter ratio of 2:1, and an outer diameter to wall thickness ratio of 8:1. As a non-limiting example, the central tube 150 has a length of 8 inches, an outer diameter of 4 inches, and a wall thickness of 0.5 inches, while the supplemental tube 170 has a length of 4 inches, an outer diameter of 2 inches, and a wall thickness of 0.25 inches.

In at least one embodiment, the supplemental tube 170 extends from a pedestal 174 that extends from the second end plate 152. The supplemental tube 170 connects to a guide tube 176 that extends from the first end plate 150 into a central chamber 177 of the supplemental tube 170. The guide tube 176 ensures that the supplemental tube 170 remains longitudinally aligned as the central tube 154 deforms.

During deformation, as the central tube 154 deforms, the supplemental tube 170 is urged toward the first end plate 150 and is aligned by the guide tube 176. As the supplemental tube 170 abuts against the first end plate 150, the supplemental tube 170 deforms similar to the central tube 154, as described herein.

The addition of the supplemental tube 170 provides additional deformation and energy attenuation. Deformation of the supplemental tube 170 provides additional concertina buckling, for example, that provides a smoother and more desirable force travel curve.

Figure 10:
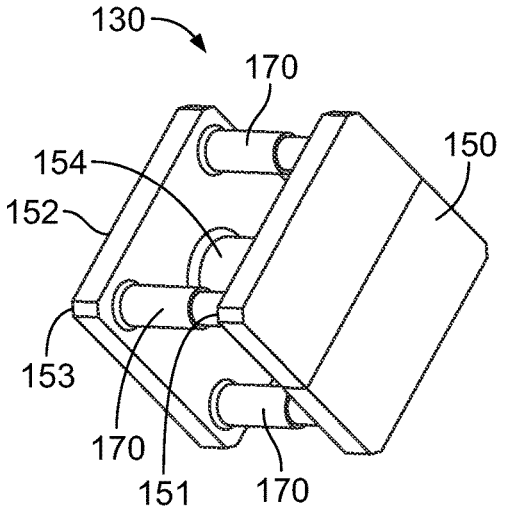
FIG. 10 illustrates a perspective view of a crash energy management system, according to an embodiment of the present disclosure.
Figure 11:
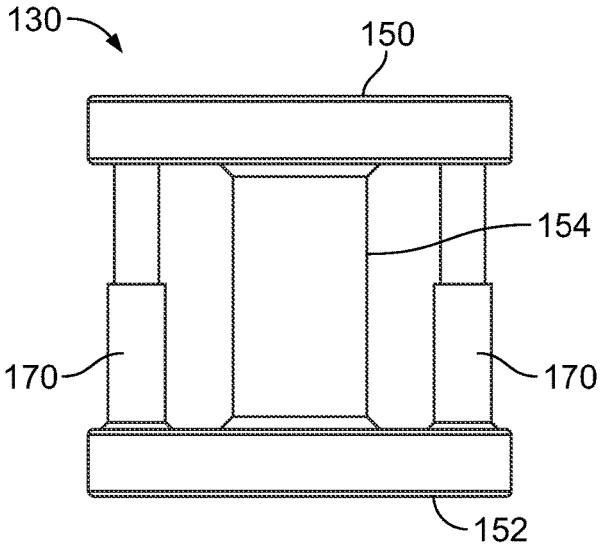
FIG. 11 illustrates a lateral view of the crash energy management system of FIG. 10.

FIG. 10 illustrates a perspective view of the crash energy management system 130, according to an embodiment of the present disclosure. FIG. 11 illustrates a lateral view of the crash energy management system 130 of FIG. 10. In this embodiment, depending on the amount of energy attenuation desired, supplemental tubes 170, as described with respect to FIG. 9, can be disposed at corners of the crash energy management system 130. For example, an exterior supplemental tube 170 can be disposed between a first corner 151 of the first end plate 150, and a first corner 153 of the second end plate 152. Each supplemental tube 170 is parallel to the central tube 154. As shown, the crash energy management system 130 can include four supplemental tubes 170.

The supplemental tubes 170 are exterior in that each is not disposed within the central tube 154. The central tube 154 may also include a supplemental tube 170 disposed therein, as described with respect to FIG. 9. The crash energy management system 130 can include more or less supplemental tubes 170 than shown. For example, the crash energy management system 130 can include two supplemental tubes 170 in addition to the central tube 154.

Referring to FIGS. 9-11, in at least one embodiment, the supplemental tubes 170 are sized, shaped, and configured to activate (for example, initiate deformation) such that the ensuring deformation contributes to help smooth an overall force vs. travel curve. The main, central tube 154 may deform and cause one or more aberrations (for example, dips) in the curve. The supplemental tubes 170 are configured to fill in such aberrations.

Figure 12:
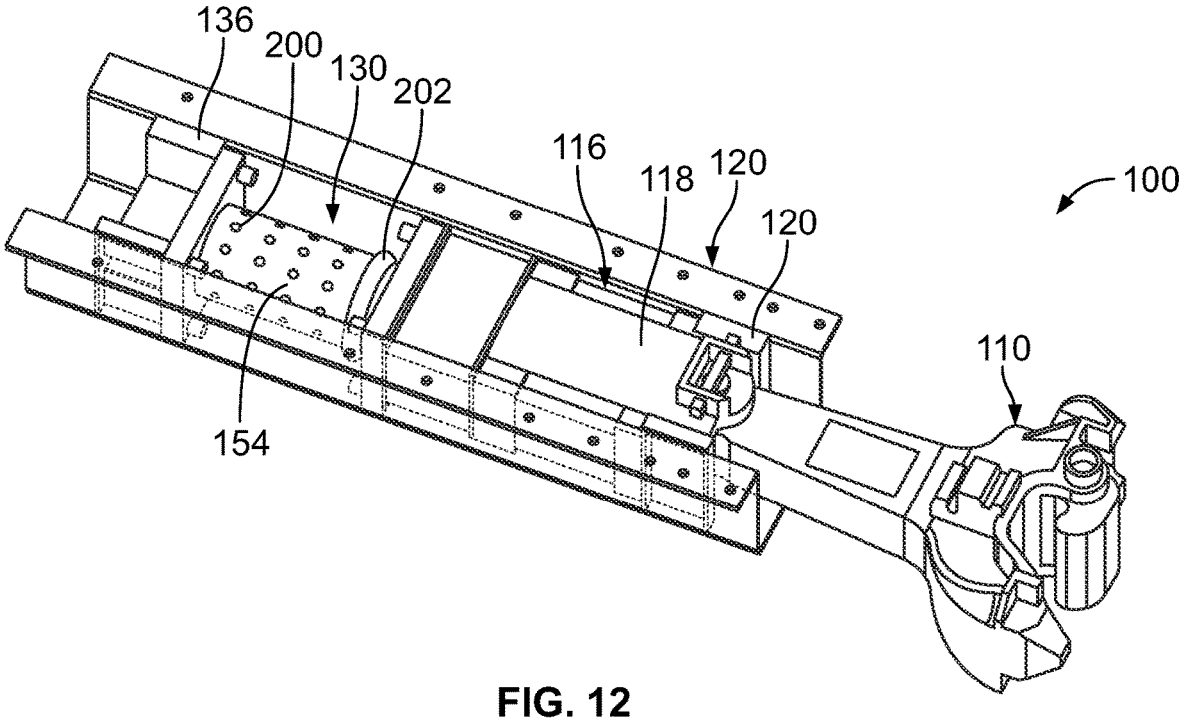
FIG. 12 illustrates a perspective bottom view of a car coupling system, according to an embodiment of the present disclosure.

FIG. 12 illustrates a perspective bottom view of the car coupling system 100, according to an embodiment of the present disclosure. As shown, the crash energy management system 130 can include one or more indentations, recesses, or channels 200 formed therein or therethrough, such as through the central tube 154. Further, the crash energy management system 130 can include one or more radial rims 202 radially extending from an outer surface of the central tube 154.

Figure 13:
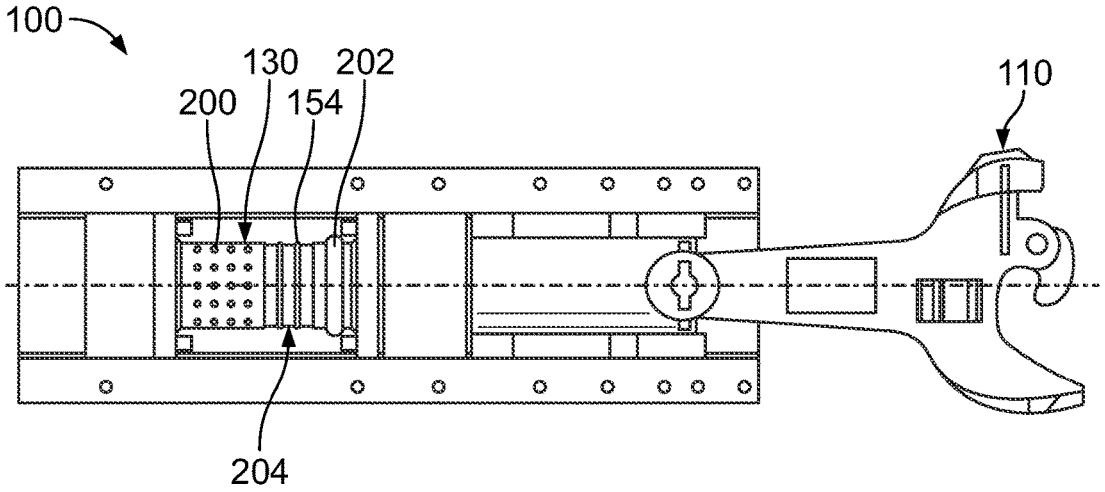
FIG. 13 illustrates a bottom view of a car coupling system, according to an embodiment of the present disclosure.

FIG. 13 illustrates a bottom view of a car coupling system 100, according to an embodiment of the present disclosure. The crash energy management system 130 can include one or more annular recesses 204 formed into the central tube 154.

Figure 14:
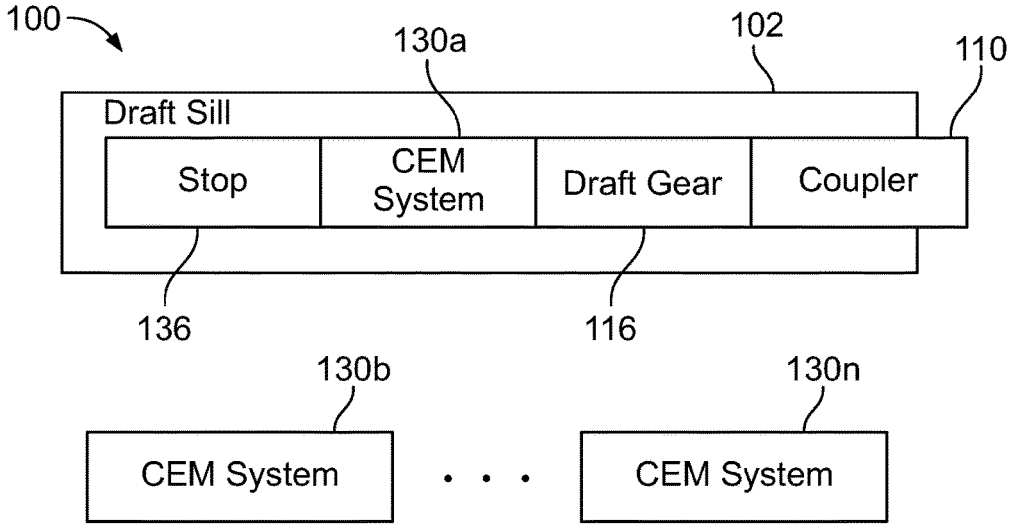
FIG. 14 illustrates a schematic block diagram of a car coupling system, according to an embodiment of the present disclosure.

FIG. 14 illustrates a schematic block diagram of a car coupling system 100, according to an embodiment of the present disclosure. Referring to FIGS. 3-14, in at least one embodiment, the car coupling system 100 is a modular car coupling system in which different crash energy management systems can be interchangeably disposed within the draft sill 102.

As shown and described, the crash energy management system 130*a*, such as any of those described herein, is disposed between the draft gear 116 and the second stop 136. The crash energy management system 130*a* can be removed from the draft sill 102 and replaced with any of a number of different crash energy management systems 130*b*, . . . or 130*n*. The crash energy management system 130*a* can be replaced with a different crash energy management system 130*b*, . . . or 130*n* that may be configured the same as the crash energy management system 130*a*. For example, the crash energy management system 130*a* may need to be replaced for maintenance. As another example, the crash energy management system 130*a* may be replaced with a different crash energy management system 130*b*, . . . or 130*n* that is configured differently than the crash energy management system 130*a*. In particular, the crash energy management system 130*b*, . . . or 130*n* may be sized and shaped differently than the crash energy management system 130*a*.

The replacement crash energy management system 130*b*, . . . or 130*n* may differ with respect to the crash energy management system 130*a* with respect to one or more of the respective central tubes 154 having different lengths, different diameters, and/or different wall thicknesses. For example, the crash energy management system 130*a* includes a central tube 154 having a first length, a first diameter, and a first wall thickness, while a replacement crash energy management system, such as the crash energy management system 130*b* includes a central tube 154 having a second length, a second diameter, and a second wall thickness. The first length may differ from the second length. The first diameter may differ from the second diameter. The first wall thickness may differ from the second wall thickness.

As another example, the crash energy management system 130*a* may have one or more supplemental tubes 170, while the crash energy management system 130*b* may not have any supplemental tubes 170, or vice versa. As another example, both the crash energy management systems 130*a* and 130*b* may have one or more supplemental tubes 170, but such may differ in one or more of length, diameter, and/or wall thickness. As another example, the crash energy management system 130*a* may have one or more supplemental tubes 170 outside of central tube 154, while the crash energy management system 130*b* does not, or vice versa. As another example, both the crash energy management system 130*a* and 130*b* may have supplemental tubes 170 outside of the central tube 154, but the respective supplemental tubes 170 may differ in or more of length, diameter, and/or wall thickness.

In at least one embodiment, the supplemental tubes 170 of each and/or separate crash energy management systems 130 can be uniquely staggered in their initiation for fine tuning of the force travel curve. For example, a crash energy management system 130 can include multiple supplemental tubes 170, as described herein, with at least two of the supplemental tubes 170 being configured to deform in response to different magnitudes of force. At least two of the supplemental tubes 170 within one crash energy management system 130 can be differently configured. As another example, supplemental tubes 170 of different crash energy management systems 130, whether or not within a common draft sill 102, can be configured to deform to different magnitudes of force.

Various different crash energy management systems 130*a*-130*n* may be interchangeably disposed within the draft sill 102, as desired. Different crash energy management system 130*a*-130*n* may be used based on a desired amount of crash energy management for a particular application. Further, the crash energy management system 130*a*-130*n* may be disposed at different locations within the draft sill 102, depending on a desired area of crash energy management. For example, the crash energy management system 130*a*-130*n* can be disposed aft of the second stop 136, between the coupler 110 and the draft gear 116, and/or the like. As another example, multiple crash energy management systems 130*a*-130*n* may be disposed within the draft sill 102. For example, the crash energy management system 130*a* can be disposed between the draft gear 116 and the second stop 136, while an additional crash energy management system 130*b*, . . . or 130*n* can also be disposed within the draft sill 102. The additional crash energy management system 130*b*, . . . or 130*n* can be separated from the crash energy management system 130*a*. As another example, the additional crash energy management system 130*b*, . . . or 130*n* can be directly coupled to the crash energy management system 130*a*. For example, the crash energy management system 130*b* can abut into an aft end of the crash energy management system 130*a*. As such, the crash energy management system 130*b* can be disposed between the crash energy management system 130*a* and the second stop 136.

In at least one embodiment, two or more crash energy management systems 130*a*-130*n* can be disposed within the draft sill 102. For example, three crash energy management systems 130 can be disposed within the draft sill 102. The crash energy management systems 130 can be directly linked together, such as between the draft gear 116 and the second stop 136, or at least two of the crash energy management systems 130 can be separated from one another by a component other than another crash energy management system 130.

As described herein, the crash energy management systems 130*a*-130*n* provide mechanical fuses that are configured to deform when a force exceeding a predetermined force threshold is exerted into the car coupling system 100. By deforming in response to the force that exceeds a predetermined force threshold, the crash energy management systems 130*a*-130*n* attenuate and absorb at least a portion of the force, thereby ensuring that other components of the car coupling system 100 and associated rail car are not subjected to the peak force. In this manner, the crash energy management systems 130 prevent or otherwise reduce potential damage to the car coupling system 100 and the rail car.

Figure 15:
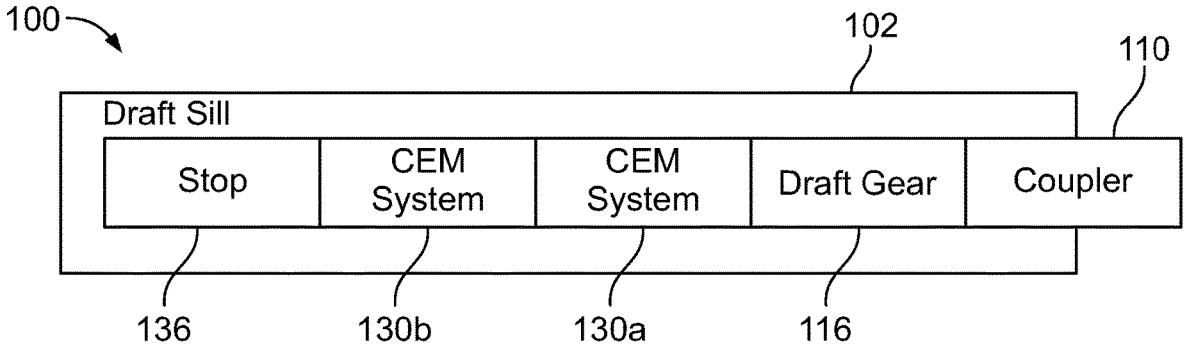
FIG. 15 illustrates a schematic block diagram of a car coupling system, according to an embodiment of the present disclosure.

FIG. 15 illustrates a schematic block diagram of a car coupling system 100, according to an embodiment of the present disclosure. As shown in FIG. 15, a first crash energy management system 130*a* is disposed aft of the draft gear 116, as described herein. A second crash energy management system 130*b* is disposed aft of the crash energy management system 130*b*. As such, the second crash energy management system 130*b* is disposed between the first crash energy management system 130*a* and the second stop 136. In this manner, the first and second crash energy management systems 130*a* and 130*b* are in series within the draft sill 102.

In at least one embodiment, the first crash energy management system 130*a* abuts directly into the second crash energy management system 130*b*. For example, referring to FIGS. 3-15, a first end plate 150 of the second crash energy management system 130*b* abuts directly against a second end plate 152 of the first crash energy management system 130*a*. The first end plate 150 of the second crash energy management system 130*b* may or may not be fastened to the second end plate 152 of the first crash energy management system 130*a*. In at least one other embodiment, the first energy management system 130*a* and the second energy management system 130*b* may be integrally molded and formed together. As an example, the second end plate 152 of the first crash energy management system 130*a* can be the first end plate 150 of the second crash energy management system 130*b*. That is, a common end plate may provide the second end plate 152 of the first crash energy management system 130*a* as well as the first end plate of the second crash energy management system 130*b*.

The first crash energy management system 130*a* may be configured the same as the second crash energy management system 130*b*. Optionally, the first crash energy management system 130*a* and the second crash energy management system 130*b* may differ in at least one respect (such as different length, diameter, wall thickness of respective central tubes 154, presence, locations, and/or number of supplemental tubes 170, and/or lengths, diameters, wall thickness thereof, and/or the like), as described herein.

As shown in FIG. 15, the car coupling system 100 includes two crash energy management systems 130*a* and 130*b*. Optionally, the car coupling system 100 can include three or more crash energy management systems 130, as desired.

In general, a single crash energy management system 130 may be effective up to a certain maximum stroke limit, beyond which capacity may be exceeded. If a longer stroke capacity is desired, multiple discrete crash energy management systems 130 (such as the first crash energy management system 130*a* and the second crash energy management system 130*b*) may be disposed within the draft sill 102 in series. Such a modular approach allows for additional stroke capacity, as desired. The force travel curve may have the same force values, just extended over longer distances.

Figure 16:
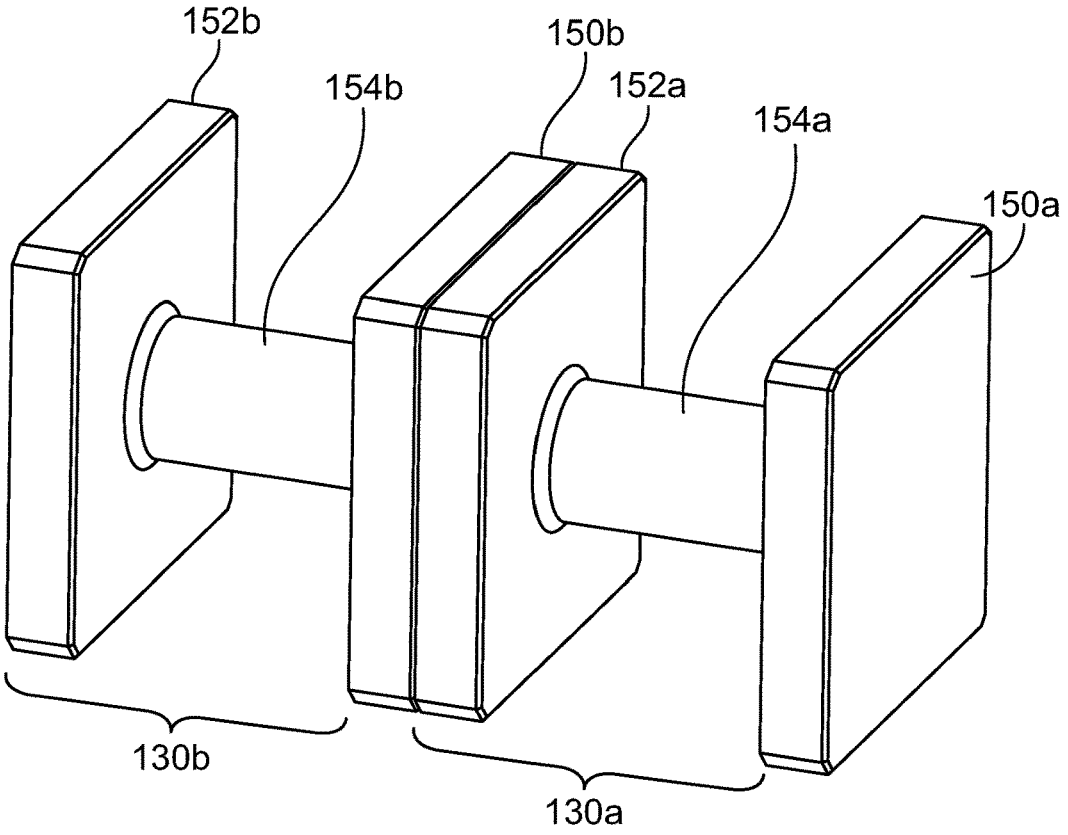
FIG. 16 illustrates a perspective view of a first crash energy management system coupled to a second crash energy management system, according to an embodiment of the present disclosure.

FIG. 16 illustrates a perspective view of the first crash energy management system 130*a* coupled to the second crash energy management system 130*b*, according to an embodiment of the present disclosure. As shown, the first end plate 150*b* of the second crash energy management system 130*b* abuts and directly connects to the second end plate 152*a* of the first crash energy management system 130*a*. The first end plate 150*b* and the second end plate 152*a* may or may not be secured together, such as with fasteners, adhesives, and/or the like.

The first end plate 150*b* of the second crash energy management system 130*b* may be considered a third end plate, so as to clearly distinguish from the first end plate 150*a* of the first crash energy management system 130*a*. Similarly, the second end plate 152*b* of the second crash energy management system 130*b* may be considered a fourth end plate, so as to clearly distinguish from the second end plate 152*a* of the first crash energy management system 130*a*. Further, the central tube 154*a* of the first crash energy management system 130*a* may be considered a first central tube, while the central tube 154*b* of the second crash energy management system 130*b* may be considered a second central tube.

In at least one embodiment, the first and second central tubes can be configured to act in unison, deforming at the same time once the initial predetermined force value is achieved. In this manner, the stroke of deformation can be achieved.

Figure 17:
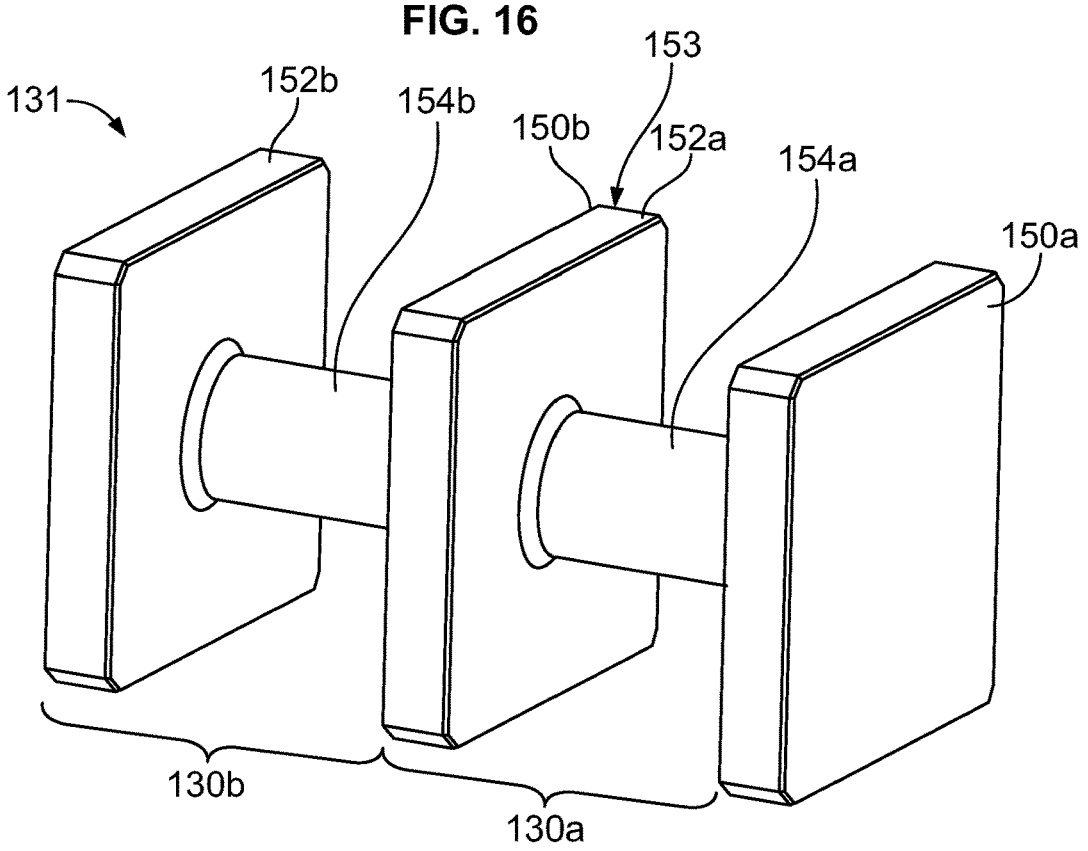
FIG. 17 illustrates a perspective view of a first crash energy management system coupled to a second crash energy management system, according to an embodiment of the present disclosure.

FIG. 17 illustrates a perspective view of a first crash energy management system 130*a* coupled to a second crash energy management system 130*b*, according to an embodiment of the present disclosure. As shown, the first crash energy management system 130*a* and the second crash energy management system 130*b* are integrally formed and molded as a single, monolithic structure. A common intermediate plate 153 provides the first end plate 150*b* of the second crash energy management system 130*b* and the second end plate 152*a* of the first crash energy management system 130*a*.

As shown in FIG. 17, an integral, tandem crash energy system 131 includes the first crash energy management system 130*a* and the second crash energy management system 130*b*. The crash energy management system 131 can be integrally molded and formed as a single, monolithic structure. In at least one other embodiment, the first end plate 150*b* can be separately and securely fixed to the second end plate 152*a*, such as through welding, fasteners, adhesives, and/or the like.

Referring to FIGS. 3-17, in at least one embodiment, the car coupling system 100 for a rail vehicle includes the draft sill 102. The first crash energy management system 130*a* is disposed within the draft sill 102. The first crash energy management system 130*a* includes the first end plate 150*a*, the second end plate 152*a*, and a first central tube 154*a* disposed between the first end plate 150*a* and the second end plate 152. The first central tube 154*a* is configured to deform in response to a first force exerted into the car coupling system 100 that exceeds a first predetermined force threshold. Deformation of the first central tube 154*a* attenuates at least a portion of the first force. A second crash energy management system 130*a* is disposed within the draft sill 102. The second crash energy management system 130*b* includes a third end plate (for example, the first end plate 150*b*), a fourth end plate (for example, the second end plate 152*b*), and a second central tube 154*b* disposed between the third end plate and the fourth end plate. The second central tube 154*b* is configured to deform in response to a second force exerted into the car coupling system 100 that exceeds a second predetermined force threshold. Deformation of the second central tube 154*b* attenuates at least a portion of the second force.

In at least one embodiment, the first force equals the second force, and the first predetermined force threshold equals the second predetermined force threshold. In at least one other embodiment, the first force differs from the second force, and the first predetermined forced threshold differs from the second predetermined force threshold.

In at least one embodiment, one or both of the first crash energy management system 130*a* or the second crash energy management system 130*b* is interchangeable with a third crash energy management system 130*n*. For example, the third crash energy management system 130*n* replaces one of the first or second crash energy management systems 130*a* or 130*b*. As another example, the third crash energy management system 130*n* replaces both the first and second crash energy systems 130*a* and 130*b*, such that the car coupling system 100 includes only one crash energy management system 130, namely the crash energy management system 130*n*.

Various materials can be used to form the crash energy management systems 130 depending on a desired force threshold upon which the crash energy management systems 130 are to deform. For example, the crash energy management systems 130 can be formed of steel, aluminum, or various other metals. Additionally, the crash energy management systems 130 can be sized and shaped for concertina buckling, as described herein, to provide an ideal energy attenuator. Moreover, a material having a particular yield strength, elongation characteristics, and/or the like can be chosen depending on the desired force threshold.

In at least one embodiment, mechanical properties such as yield strength, tensile strength, and elongation may be used to tune deformation of the crash energy management systems 130 (such as the main central tubes 154 and/or any supplemental tubes 170), as desired, such as to achieve specified trigger forces and curve quality. Further, in at least one embodiment, components of the crash energy management systems 130 (such as the main central tubes 154 and/or any supplemental tubes 170) can be pre-deformed, such as to provide stability and desired deformation triggering.

Certain embodiments of the present disclosure provide a method of forming a car coupling system for a rail vehicle. The method includes disposing a crash energy management system (such as any of those described herein) within a draft sill. As an example, the crash energy management system includes a first end plate, a second end plate, and a central tube disposed between the first end plate and the second end plate. The central tube is configured to deform in response to a force exerted into the car coupling system that exceeds a predetermined force threshold. Deformation of the central tube attenuates at least a portion of the force.

As another example, the crash energy management system includes a front sub-assembly including a front end plate, guide legs extending between the front end plate and a front central plate, a front central tube extending between the front end plate and the front central plate, and stop walls coupled to the guide legs; and a rear sub-assembly coupled to the front sub-assembly including a rear end plate, a rear central plate, and a rear central tube extending between the rear end plate and the rear central plate (such as described with respect to FIGS. 18-24).

In at least one embodiment, the method further includes extending a coupler outwardly from a first end of the draft sill, disposing a first stop within the draft sill, disposing a draft gear having a yoke within the draft sill. connecting the coupler to the draft gear, and disposing a second stop within the draft sill, wherein the crash energy management system is disposed between the draft gear and the second stop.

As a further example, the method includes disposing a supplemental tube within an internal chamber of the central tube. As another or further example, the method includes disposing one or more supplemental tubes outside of the central tube.

Figure 18:
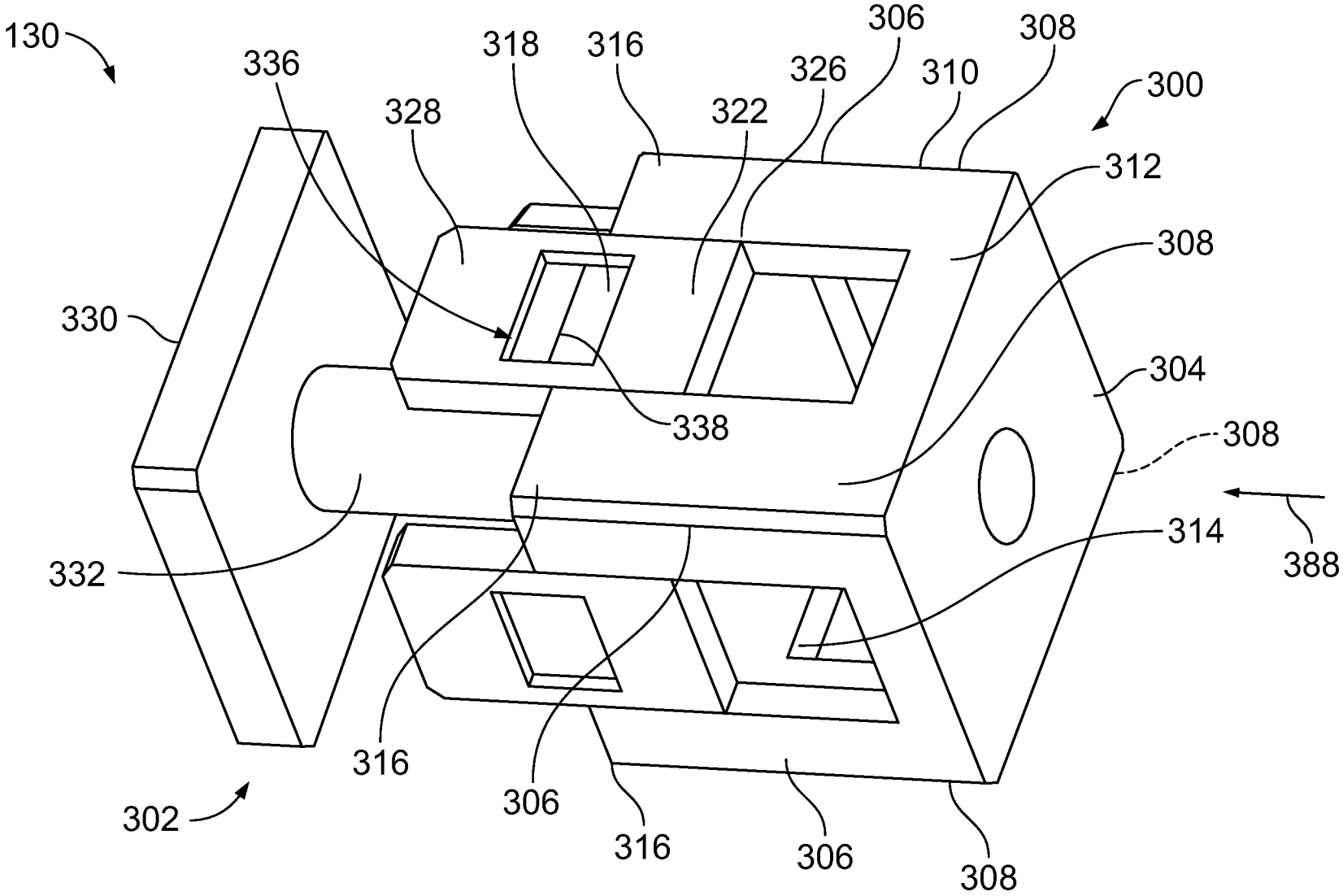
FIG. 18 illustrates a perspective front lateral view of a crash energy management system, according to an embodiment of the present disclosure.
Figure 19:
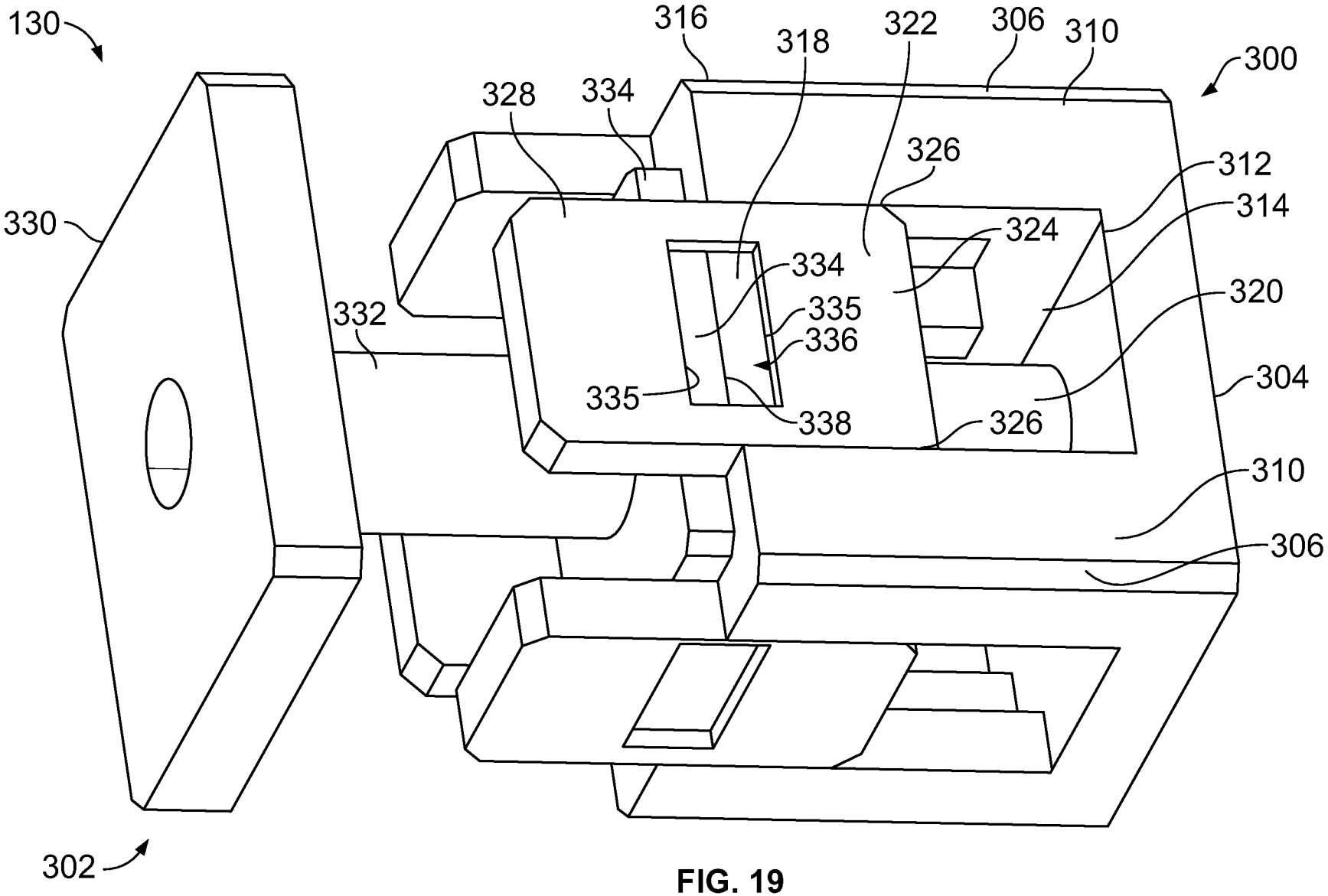
FIG. 19 illustrates a perspective rear lateral view of the crash energy management system of FIG. 18.

FIG. 18 illustrates a perspective front lateral view of a crash energy management system 130, according to an embodiment of the present disclosure. FIG. 19 illustrates a perspective rear lateral view of the crash energy management system 130 of FIG. 18. Referring to FIGS. 18 and 19, the crash energy management system 130 includes a first or front sub-assembly 300 coupled (such as secured) to a second or rear sub-assembly 302.

The front sub-assembly 300 includes a front end plate 304. Guide legs 306 extend from the front end plate 304 (such as rearwardly extending) at each corner 308. In particular, forward ends 310 of the guide legs 306 extend from rear corners surfaces 312 of the front end plate 304. The guide legs 306 are separated from each other by spaces 314. Rear ends 316 of the guide legs 306 are secured to corner exterior edges of a central plate 318 (such as a first or front central plate). A central tube 320 (for example, a first or front central tube), such as any of those described herein, extends between the front end plate 304 and the central plate 318.

A stop wall 322 is coupled between neighboring guide legs 306. Each side of the crash energy management system 130 includes a stop wall 322, as shown in FIGS. 18 and 19. For example, the crash energy management system 130 includes four stop walls 322. In at least one embodiment, the stop walls 322 are flat, planar panels. Optionally, the crash energy management system 130 may include less than four stop walls 322.

Each stop wall 322 includes a forward end 324 secured between interior edge surfaces 326 of neighboring guide legs 306. For example, the forward ends 324 can be welded to the interior edge surfaces 326. Each stop wall 322 also includes a rear end 328 that rearwardly extends toward the rear sub-assembly 302.

The rear sub-assembly 302 includes a rear end plate 330. A central tube 332 (for example, a second of rear central tube), such as any of those described herein, extends between the rear end plate 330 and a central plate 334 (such as a second or rear central plate). As shown, the rear ends 328 of the stop walls 322 extend rearwardly past the central plate 334.

In at least one embodiment, a recess pocket 336 is formed in each of the stop walls 322. The recess pocket 336 exposes portions of outer edges of the central plates 318 and 334. The recess pockets 336 allow the central plates 318 and 334 to be welded together at a weld line 338. Because the weld line 338 is within the recess pocket 336, the weld line 338 does not outwardly extend past an outer surface of the stop wall 322. As such, the weld line 338 does not extend into or past an outer envelope of the crash energy management system 130. Further, the stop walls 322 are secured to the central plates 318 and 334 at interior perimeter weld line 335 of the recess pocket 336.

Figure 20:
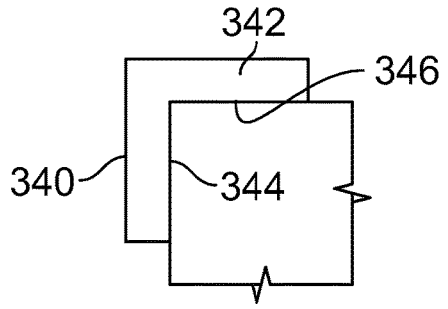
FIG. 20 illustrates an axial cross-sectional view of a guide leg secured to a central plate of a front sub-assembly, according to an embodiment of the present disclosure.

FIG. 20 illustrates an axial cross-sectional view of a guide leg 306 secured to the central plate 318 of the front sub-assembly 300, according to an embodiment of the present disclosure. Referring to FIGS. 18-20, each guide leg 306 has an L-axial cross-section including a first beam 340 connected to a second beam 342, which is orthogonal to the first beam 340. The first beam 340 is coupled to a first edge segment 344 of the central plate 318, and the second beam 342 is coupled to a second edge segment 346 (orthogonal to the first edge segment 344) of the central plate 318. In at least one embodiment, the guide legs 306 are configured to slide or otherwise move over the edge portions of the central plate 318 (and the central plate 334). For example, the guide legs 306 are configured to move over portions of the central plates 318 and 334 as the central tube 320 deforms.

Figure 21:
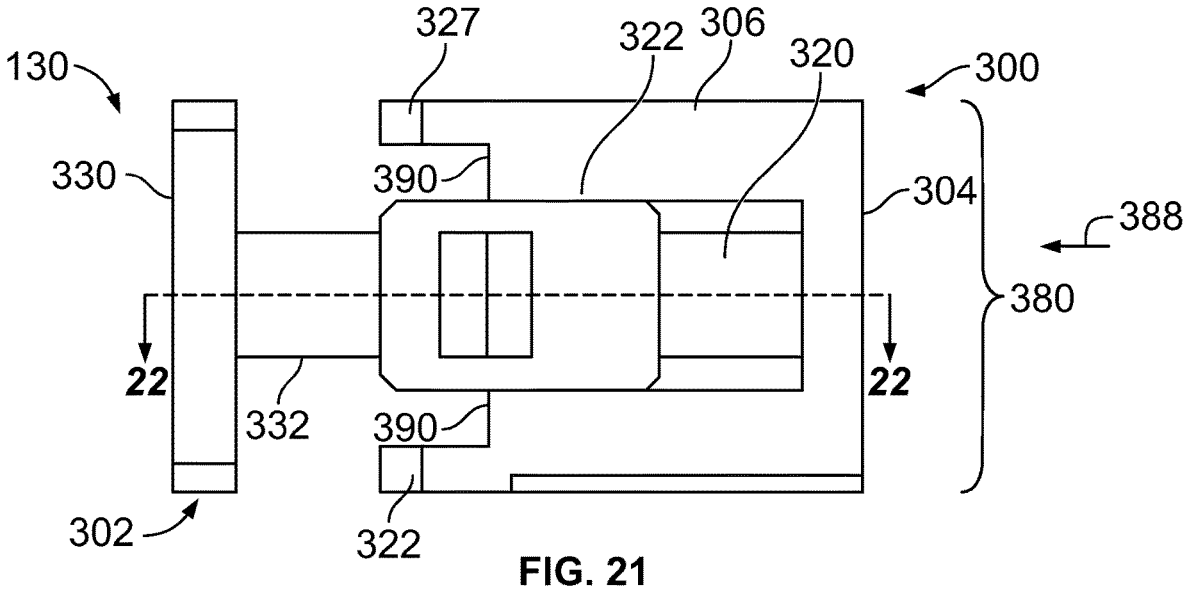
FIG. 21 illustrates a first side view of the crash energy management system of FIG. 18.
Figure 22:
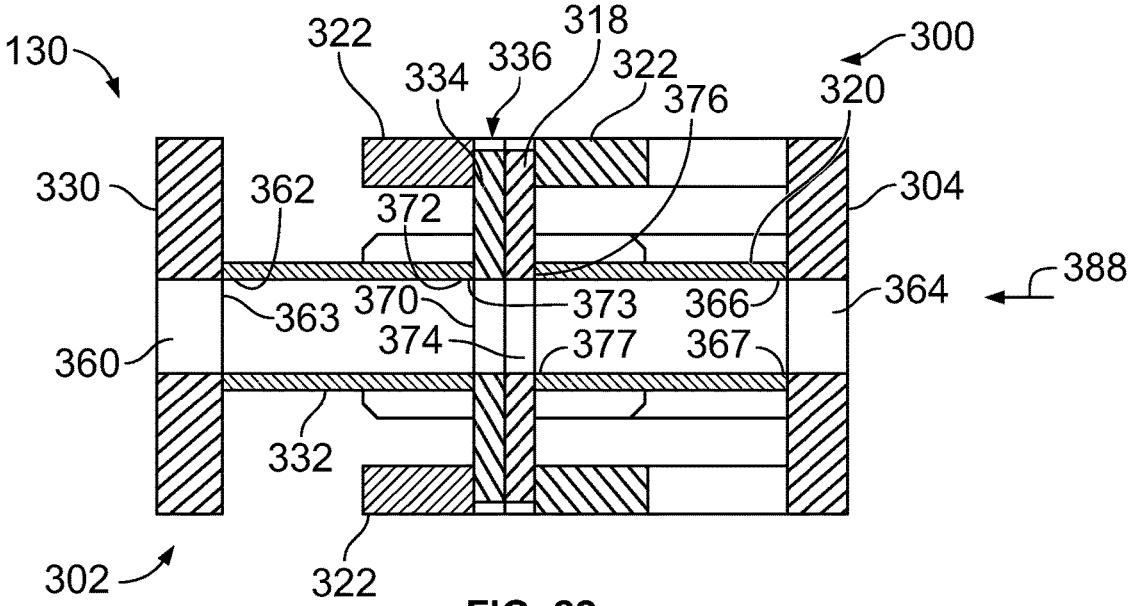
FIG. 22 illustrates a cross-sectional view of the crash energy management system through line 22-22 of FIG. 21.

FIG. 21 illustrates a first side view of the crash energy management system 130 of FIG. 18. FIG. 22 illustrates a cross-sectional view of the crash energy management system 130 through line 22-22 of FIG. 21. Referring to FIGS. 21 and 22, each of the central plates 318 and 334 is formed having half the thickness of each of the front end plate 304 and the rear end plate 330. The central plates 318 and 334 are secured together such as via weld lines, as described herein, to form a full thickness plate having the same (or approximately the same) thickness as each of the front end plate 304 and the rear end plate 330.

As shown, a central bore 360 is formed through the rear end plate 330. The central bore 360 allows for the rear end plate 330 to be welded to an inner diameter 362 of the central tube 332 at a weld line 363. Further, a central bore 364 is formed through the front end plate 304. The central bore 364 allows for the front end plate 304 to be welded to an inner diameter 366 of the central tube 320 at a weld line 367.

Similarly, a central bore 370 is formed through the central plate 334. The central bore 370 allows for the central plate 334 to be welded to an inner diameter 372 of the central tube 332 at a weld line 373. Further, a central bore 374 is formed through the central plate 318. The central bore 374 allows for the central plate 334 to be welded to an inner diameter 376 of the central tube 320 at a weld line 377.

It has been found that welding the respective plates to the inner diameters of the central tubes 320 and 332 enhances performance of the crash energy management system 130. For example, testing has demonstrated desired deformation of the central tubes 320 and 332, as described herein. Further, by forming each of the central plates 318 and 334 as half thickness plates, the central tube 320 can be welded to the central plate 318, and the central tube 334 can be welded to the central plate 334, after which the front sub-assembly 300 can then be welded to the rear sub-assembly 302. If, however, a full thickness central plate were used, the manufacturing process would be more complicated, as the process of welding a second central tube thereto would be more difficult.

Alternatively, central bores may not be formed in at least one of the front end plate 304, the rear end plate 330, the central plate 318, and/or the central plate 334. Also, alternatively, a full thickness central plate may be used, instead of half thickness central plates secured to one another.

Figure 23:
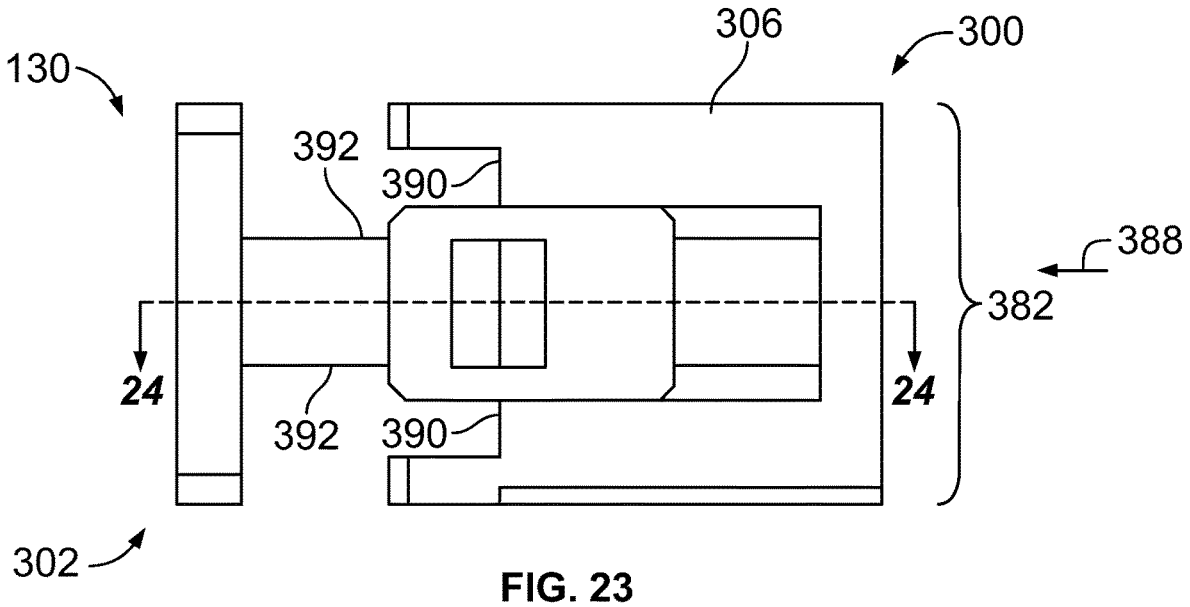
FIG. 23 illustrates a second side view of the crash energy management system of FIG. 18.
Figure 24:
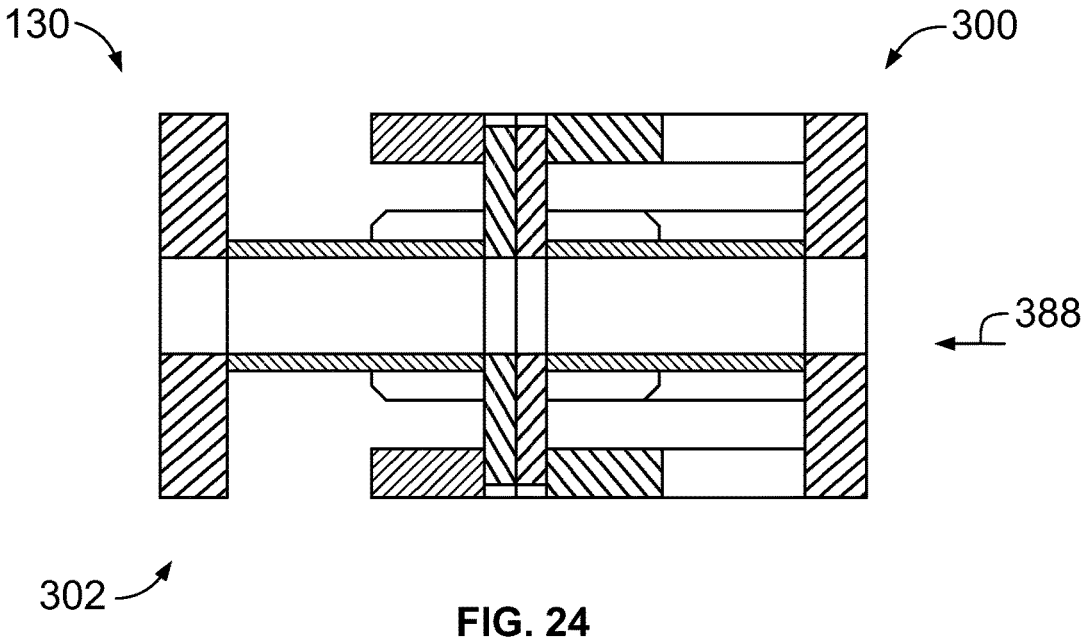
FIG. 24 illustrates a cross-sectional view of the crash energy management system through line 24-24 of FIG. 23.

FIG. 23 illustrates a second side view of the crash energy management system 130 of FIG. 18. FIG. 24 illustrates a cross-sectional view of the crash energy management system 130 through line 24-24 of FIG. 23. In at least one embodiment, a height 380 of the first side of the crash energy management system 130 may be different than a height 382 of the second side of the crash energy management system 130. Optionally, the height 380 may equal the height 382.

Referring to FIG. 18-23, when a force that exceeds a predetermined force threshold is exerted into the car coupling system in the direction of arrow A, the central tubes 320 and 332 deform, thereby absorbing and attenuating the energy of the force, as describe herein (such as with respect to FIG. 8). The central tubes 320 and 332 may deform simultaneously, or the central tube 320 may deform before the central tube 332 deforms (or vice versa).

Unlike the central tubes 320 and 332, the guide legs 306 and the stop walls 322 are not configured to deform. Instead, as the central tubes 320 and 332 deform, the guide legs 306 ride over the outer edges of the central plates 318 and 334 moving toward the rear end plate 330, and providing guidance during deformation. The guide legs 306 ride over the central plates 318 and 334, and rear edges 390 of the guide legs 306 move toward and/or into a flush position with the rear edges 392 of the stop walls 322. Further, as the central tube 332 deforms, the rear edges 390 of the guide legs and the rear edges 392 of the stop walls 322 move into an abutting relationship with the rear end plate 330. As noted, the deformation of the central tubes 320 and 332 may occur simultaneously, such that the two stage movement described herein occurs simultaneously, or a first stage of motion that includes the deformation of the central tube 320 (and resulting motion of the guide legs 306) occurs before (or after) the deformation of the central tube 332.

The guide legs 306 and the stop walls 322 provide guidance for motion of the crash energy management system 130 as the central tubes 320 and 332 deform, thereby eliminating, minimizing, or otherwise reducing a potential of rotation or lateral movement of the crash energy management system 130. Instead, force exerted into the crash energy management system 130 is controlled by the guide legs 306 and the stop walls 322 to be longitudinal in the direction of arrow 388. Even if a force is exerted into the crash energy management system 130 is not purely longitudinal, the guide legs 306 and the stop walls 322 ensure that the motion of the crash energy management system 130 during deformation of the central tubes 320 and 332 is constrained to longitudinal motion.

The rigid guide legs 306 and the stop walls 322, which are not configured to deform (as do the central tubes 320 and 332) effectively turn the front sub-assembly 300 into an expanded length plate having a thickness greater than the end plates 304 and 330. Further, the guide legs 306 and the stop walls 322 provide for such an expanded plate with far less material than if a monolithic plate having an expanded thickness were used. The guide legs 306 and stop walls 322 therefore resist rotational motion and lateral motion (which may otherwise compromise a desired deformation of central tubes and provide an undesirable force-travel curve), and ensure that forces exerted into the crash energy management system 130 are translated into purely longitudinal motion.

The crash energy management system 130 having the front sub-assembly 300 coupled to the rear sub-assembly 302, as described herein, provides force conditioning (that is, guidance) configured to convert non-longitudinal force into pure, longitudinal motion of the crash energy management system 130. The guide legs 306 and the stop walls 322 provide enhanced resistance to rotation and lateral shifting as the central tubes 320 and 332 deform.

In at least one embodiment, the central tubes 320 and 332 are configured the same as the central tube 154, which is shown and described with respect to FIGS. 5-8. In particular, in at least one embodiment, the central tubes 320 and 332 are hollow, having an internal chamber. In order to achieve concertina buckling upon deformation, the ratio of the length to outer diameter of the central tubes 320 and 332 is 2:1. Further, in order to achieve concertina buckling, the ratio of the outer diameter to the wall thickness of the central tubes 320 and 332 is 8:1. Alternatively, the outer tube of each of the central tubes 320 and 332 can be sized and shaped differently so as not to provide concertina buckling.

In at least one embodiment, one or both of the central tubes 320 and/or 332 can includes a supplemental tube, such as the supplemental tube 170 shown in FIG. 9. That is, one or both of the central tubes 320 and/or 332 can be configured as shown and described with respect to FIG. 9.

In at least one embodiment, one or both of the front sub-assembly 300 and/or the rear sub-assembly 302 can include one or more supplemental tubes outside of the central tubes 320 and 332. For example, supplemental tubes can be disposed proximate to the guide legs 306, such as described with respect to FIGS. 10 and 11.

The crash energy management system 130 shown and described with respect to FIGS. 18-24 can be used with the modular car coupling system shown and described with respect to FIG. 14. The crash energy management system 130 shown and described with respect to FIGS. 18-24 is configured to be disposed within a draft sill, such as the draft sill 102 shown and described with respect to FIGS. 3, 4, 14, and 15.

Further, the disclosure comprises embodiments according to the following clauses:

Clause 1. A crash energy management system configured to be disposed within a draft sill of a car coupling system for a rail vehicle, the crash energy management system comprising:

a front sub-assembly including a front end plate, guide legs extending between the front end plate and a front central plate, a front central tube extending between the front end plate and the front central plate, and stop walls coupled to the guide legs; and a rear sub-assembly coupled to the front sub-assembly, wherein the rear sub-assembly includes a rear end plate, a rear central plate, and a rear central tube extending between the rear end plate and the rear central plate.

Clause 2. The crash energy management system of Clause 1, wherein the guide legs extend from the front end plate at corners.

Clause 3. The crash energy management system of Clauses 1 or 2, wherein each of the stop walls comprises:

a forward end secured between interior edges surfaces of neighboring ones of the guide legs; and a rear end that extends toward the rear sub-assembly.

Clause 4. The crash energy management system of any of Clauses 1-3, wherein one or more of the stop walls comprises a recess pocket that exposes one or more weld lines of the front central plate and the rear central plate.

Clause 5. The crash energy management system of any of Clauses 1-4, wherein the stop walls are welded to the front central plate and the rear central plate.

Clause 6. The crash energy management system of any of Clauses 1-5, wherein one or more of the guide legs includes a first beam connected to a second beam, which is orthogonal to the first beam.

Clause 7. The crash energy management system of any of Clauses 1-6, wherein the guide legs are configured to move over portions of the front central plate and the rear central plate as the front central tube deforms.

Clause 8. The crash energy management system of any of Clauses 1-7, wherein each of the front central plate and the rear central plate is half the thickness of each of the front end plate and the rear end plate.

Clause 9. The crash energy management system of Clause 8, wherein the front central plate is welded to the rear central plate.

Clause 10. The crash energy management system of any of Clauses 1-9, wherein one or both of the front end plate or the front central plate comprises a front central bore that allows for welding to an inner diameter of the front central tube, and wherein one or both of the rear end plate or the rear central plate comprises a rear central bore that allows for welding to an inner diameter of the rear central tube.

Clause 11. The crash energy management system of any of Clauses 1-10, wherein each of the front central tube and the rear central tube has a length, an outer diameter, and a wall thickness, wherein a ratio of the length to the outer diameter is 2:1, and wherein a ratio of the outer diameter to the wall thickness is 8:1.

Clause 12. A method of forming a car coupling system for a rail vehicle, the method comprising:

disposing a crash energy management system within a draft sill, wherein the crash energy management system comprises:

a front sub-assembly including a front end plate, guide legs extending between the front end plate and a front central plate, a front central tube extending between the front end plate and the front central plate, and stop walls coupled to the guide legs; and a rear sub-assembly coupled to the front sub-assembly, wherein the rear sub-assembly includes a rear end plate, a rear central plate, and a rear central tube extending between the rear end plate and the rear central plate.

Clause 13. The method of Clause 12, further comprising:

extending a coupler outwardly from a first end of the draft sill;

disposing a first stop within the draft sill;

disposing a draft gear having a yoke within the draft sill;

connecting the coupler to the draft gear; and disposing a second stop within the draft sill, wherein the crash energy management system is disposed between the draft gear and the second stop.

Clause 14. A car coupling system for a rail vehicle, the car coupling system comprising:

a draft sill;

a coupler extending outwardly from a first end of the draft sill;

a first stop within the draft sill;

a draft gear having a yoke within the draft sill, wherein the coupler connects to the draft gear;

a second stop within the draft sill; and a crash energy management system disposed between the draft gear and the second stop within the draft sill, wherein the crash energy management system comprises:

a front sub-assembly including a front end plate, guide legs extending between the front end plate and a front central plate, a front central tube extending between the front end plate and the front central plate, and stop walls coupled to the guide legs; and a rear sub-assembly coupled to the front sub-assembly, wherein the rear sub-assembly includes a rear end plate, a rear central plate, and a rear central tube extending between the rear end plate and the rear central plate.

Clause 15. The car coupling system of Clause 14, wherein the guide legs extend from the front end plate at corners.

Clause 16. The car coupling system of Clauses 14 or 15, wherein each of the stop walls comprises:

a forward end secured between interior edges surfaces of neighboring ones of the guide legs; and a rear end that extends toward the rear sub-assembly.

Clause 17. The car coupling system of any of Clauses 14-16, wherein one or more of the stop walls comprises a recess pocket that exposes one or more weld lines of the front central plate and the rear central plate, and wherein the stop walls are welded to the front central plate and the rear central plate.

Clause 18. The car coupling system of any of Clauses 14-17, wherein the guide legs are configured to move over portions of the front central plate and the rear central plate as the front central tube deforms.

Clause 19. The car coupling system of any of Clauses 14-18, wherein each of the front central plate and the rear central plate is half the thickness of each of the front end plate and the rear end plate, and wherein the front central plate is welded to the rear central plate.

Clause 20. The car coupling system of any of Clauses 14-19, wherein one or both of the front end plate or the front central plate comprises a front central bore that allows for welding to an inner diameter of the front central tube, and wherein one or both of the rear end plate or the rear central plate comprises a rear central bore that allows for welding to an inner diameter of the rear central tube.

As described herein, embodiments of the present disclosure provide systems and methods for attenuating energy exerted into a car coupling system. Further, embodiments of the present disclosure provide systems and methods that absorb energy that exceeds a predetermined force threshold. Moreover, embodiments of the present disclosure provide efficient, effective, and low cost systems for absorbing and attenuating such energy.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed:

1. A crash energy management system configured to be disposed within a draft sill of a car coupling system for a rail vehicle, the crash energy management system comprising:

a front sub-assembly including a front end plate, guide legs extending between the front end plate and a front central plate, a front central tube extending between the front end plate and the front central plate, and stop walls coupled to the guide legs; and a rear sub-assembly coupled to the front sub-assembly, wherein the rear sub-assembly includes a rear end plate, a rear central plate, and a rear central tube extending between the rear end plate and the rear central plate, wherein the guide legs are configured to move over portions of the front central plate and the rear central plate as the front central tube deforms.

2. The crash energy management system of claim 1, wherein the guide legs extend from the front end plate at corners.

3. The crash energy management system of claim 1, wherein each of the stop walls comprises:

a forward end secured between interior edges surfaces of neighboring ones of the guide legs; and a rear end that extends toward the rear sub-assembly.

4. The crash energy management system of claim 1, wherein one or more of the stop walls comprises a recess pocket that exposes one or more weld lines of the front central plate and the rear central plate.

5. The crash energy management system of claim 1, wherein the stop walls are welded to the front central plate and the rear central plate.

6. The crash energy management system of claim 1, wherein one or more of the guide legs includes a first beam connected to a second beam, which is orthogonal to the first beam.

7. The crash energy management system of claim 1, wherein each of the front central plate and the rear central plate is half the thickness of each of the front end plate and the rear end plate.

8. The crash energy management system of claim 7, wherein the front central plate is welded to the rear central plate.

9. The crash energy management system of claim 1, wherein one or both of the front end plate or the front central plate comprises a front central bore that allows for welding to an inner diameter of the front central tube, and wherein one or both of the rear end plate or the rear central plate comprises a rear central bore that allows for welding to an inner diameter of the rear central tube.

10. The crash energy management system of claim 1, wherein each of the front central tube and the rear central tube has a length, an outer diameter, and a wall thickness, wherein a ratio of the length to the outer diameter is 2:1, and wherein a ratio of the outer diameter to the wall thickness is 8:1.

11. A method of forming a car coupling system for a rail vehicle, the method comprising:

extending a coupler outwardly from a first end of a draft sill;

disposing a first stop within the draft sill;

disposing a draft gear having a yoke within the draft sill;

connecting the coupler to the draft gear;

disposing a second stop within the draft sill; and disposing a crash energy management system within the draft sill between the draft gear and the second stop, wherein the crash energy management system comprises:

a front sub-assembly including a front end plate, guide legs extending between the front end plate and a front central plate, a front central tube extending between the front end plate and the front central plate, and stop walls coupled to the guide legs; and a rear sub-assembly coupled to the front sub-assembly, wherein the rear sub-assembly includes a rear end plate, a rear central plate, and a rear central tube extending between the rear end plate and the rear central plate.

12. A car coupling system for a rail vehicle, the car coupling system comprising:

a draft sill;

a coupler extending outwardly from a first end of the draft sill;

a first stop within the draft sill;

a draft gear having a yoke within the draft sill, wherein the coupler connects to the draft gear;

a second stop within the draft sill; and a crash energy management system disposed between the draft gear and the second stop within the draft sill, wherein the crash energy management system comprises:

a front sub-assembly including a front end plate, guide legs extending between the front end plate and a front central plate, a front central tube extending between the front end plate and the front central plate, and stop walls coupled to the guide legs; and a rear sub-assembly coupled to the front sub-assembly, wherein the rear sub-assembly includes a rear end plate, a rear central plate, and a rear central tube extending between the rear end plate and the rear central plate.

13. The car coupling system of claim 12, wherein the guide legs extend from the front end plate at corners.

14. The car coupling system of claim 12, wherein each of the stop walls comprises:

a forward end secured between interior edges surfaces of neighboring ones of the guide legs; and a rear end that extends toward the rear sub-assembly.

15. The car coupling system of claim 12, wherein one or more of the stop walls comprises a recess pocket that exposes one or more weld lines of the front central plate and the rear central plate, and wherein the stop walls are welded to the front central plate and the rear central plate.

16. The car coupling system of claim 12, wherein the guide legs are configured to move over portions of the front central plate and the rear central plate as the front central tube deforms.

17. The car coupling system of claim 12, wherein each of the front central plate and the rear central plate is half the thickness of each of the front end plate and the rear end plate, and wherein the front central plate is welded to the rear central plate.

18. The car coupling system of claim 12, wherein one or both of the front end plate or the front central plate comprises a front central bore that allows for welding to an inner diameter of the front central tube, and wherein one or both of the rear end plate or the rear central plate comprises a rear central bore that allows for welding to an inner diameter of the rear central tube.

19. A crash energy management system configured to be disposed within a draft sill of a car coupling system for a rail vehicle, the crash energy management system comprising:

a front sub-assembly including a front end plate, guide legs extending between the front end plate and a front central plate, a front central tube extending between the front end plate and the front central plate, and stop walls coupled to the guide legs; and a rear sub-assembly coupled to the front sub-assembly, wherein the rear sub-assembly includes a rear end plate, a rear central plate, and a rear central tube extending between the rear end plate and the rear central plate, wherein one or more of the stop walls comprises a recess pocket that exposes one or more weld lines of the front central plate and the rear central plate.

20. A crash energy management system configured to be disposed within a draft sill of a car coupling system for a rail vehicle, the crash energy management system comprising:

a front sub-assembly including a front end plate, guide legs extending between the front end plate and a front central plate, a front central tube extending between the front end plate and the front central plate, and stop walls coupled to the guide legs; and a rear sub-assembly coupled to the front sub-assembly, wherein the rear sub-assembly includes a rear end plate, a rear central plate, and a rear central tube extending between the rear end plate and the rear central plate, wherein the stop walls are welded to the front central plate and the rear central plate.

21. A crash energy management system configured to be disposed within a draft sill of a car coupling system for a rail vehicle, the crash energy management system comprising:

a front sub-assembly including a front end plate, guide legs extending between the front end plate and a front central plate, a front central tube extending between the front end plate and the front central plate, and stop walls coupled to the guide legs; and a rear sub-assembly coupled to the front sub-assembly, wherein the rear sub-assembly includes a rear end plate, a rear central plate, and a rear central tube extending between the rear end plate and the rear central plate, wherein each of the front central plate and the rear central plate is half the thickness of each of the front end plate and the rear end plate.

22. The crash energy management system of claim 21, wherein the front central plate is welded to the rear central plate.

23. A crash energy management system configured to be disposed within a draft sill of a car coupling system for a rail vehicle, the crash energy management system comprising:

a front sub-assembly including a front end plate, guide legs extending between the front end plate and a front central plate, a front central tube extending between the front end plate and the front central plate, and stop walls coupled to the guide legs, wherein one or both of the front end plate or the front central plate comprises a front central bore that allows for welding to an inner diameter of the front central tube; and a rear sub-assembly coupled to the front sub-assembly, wherein the rear sub-assembly includes a rear end plate, a rear central plate, and a rear central tube extending between the rear end plate and the rear central plate, wherein one or both of the rear end plate or the rear central plate comprises a rear central bore that allows for welding to an inner diameter of the rear central tube.

24. A crash energy management system configured to be disposed within a draft sill of a car coupling system for a rail vehicle, the crash energy management system comprising:

a front sub-assembly including a front end plate, guide legs extending between the front end plate and a front central plate, a front central tube extending between the front end plate and the front central plate, and stop walls coupled to the guide legs; and a rear sub-assembly coupled to the front sub-assembly, wherein the rear sub-assembly includes a rear end plate, a rear central plate, and a rear central tube extending between the rear end plate and the rear central plate, wherein each of the front central tube and the rear central tube has a length, an outer diameter, and a wall thickness, wherein a ratio of the length to the outer diameter is 2:1, and wherein a ratio of the outer diameter to the wall thickness is 8:1.

* * * * *